United States Patent [19]

Haraden

[11] Patent Number: 4,654,557

[45] Date of Patent: Mar. 31, 1987

[54] LAMP HOLDER ASSEMBLY HAVING ROTATABLE BASE

[75] Inventor: Thomas Haraden, Ipswich, Mass.

[73] Assignee: GTE Products Corporation, Danvers, Mass.

[21] Appl. No.: 722,945

[22] Filed: Apr. 12, 1985

[51] Int. Cl.[4] ..... H01J 5/48; H01J 5/50

[52] U.S. Cl. ..... 313/318; 313/51; 339/93 L; 339/119 L; 339/2 L

[58] Field of Search ..... 313/318, 51, 332, 493; 338/72; 339/93 L, 176 L, 1 L, 2 L; 315/51, 53

[56] References Cited

U.S. PATENT DOCUMENTS

| | | | |
|---|---|---|---|
| 1,571,696 | 2/1926 | Benjamin | 339/158 |
| 1,631,575 | 6/1927 | Berry | 339/8 P |
| 2,138,780 | 11/1938 | Birdseye | 313/113 |
| 2,194,329 | 3/1940 | Sokoloff | 339/8 R |
| 2,235,656 | 3/1941 | Thal | 339/2 L |
| 2,444,278 | 6/1948 | Betts | 313/318 |
| 2,871,455 | 1/1959 | Richardson | 339/8 R |
| 4,029,954 | 6/1977 | Moyer | 339/8 R |
| 4,039,821 | 8/1977 | Greene et al. | 339/154 L |
| 4,093,333 | 6/1978 | Tjornhom, Sr. | 339/154 L |
| 4,100,448 | 7/1978 | Chipner et al. | 313/318 |
| 4,198,112 | 4/1980 | Miller | 339/176 L |
| 4,258,287 | 3/1981 | Hetzel | 315/58 |
| 4,347,460 | 8/1982 | Latassa et al. | 315/63 |
| 4,405,877 | 9/1983 | Haraden et al. | 313/318 |
| 4,406,969 | 9/1983 | Haraden et al. | 313/318 |
| 4,426,602 | 1/1984 | Mollet et al. | 315/58 |

FOREIGN PATENT DOCUMENTS

| | | | |
|---|---|---|---|
| 854225 | 4/1959 | United Kingdom | 339/2 L |

*Primary Examiner*—David K. Moore
*Assistant Examiner*—Theodore C. Salindong
*Attorney, Agent, or Firm*—Carlo S. Bessone

[57] ABSTRACT

A lamp holder assembly for use with an incandescent fixture includes a base that provides a predetermined amount of rotational movement relative to the housing to allow proper orientation of the assembly with respect to the incandescent fixture. In one embodiment, a rib located on the internal surface of the base engages an arcuate-shaped projecting member at two spaced apart positions of movement. The spaced apart positions of movement define the amount of rotational movement which preferably is 180°.

16 Claims, 10 Drawing Figures

LAMP HOLDER ASSEMBLY HAVING ROTATABLE BASE

TECHNICAL FIELD

This invention relates to lamp holder assemblies and more particularly to such assemblies employed for fitting lamps to the sockets of incandescent lamp fixtures.

BACKGROUND OF THE INVENTION

Because of the increasing cost of electrical energy the substitution of initially costlier but more energy efficient lamp types in place of incandescent lamps has become practical. A prime candidate for this substitution is the fluorescent lamp, primarily because of its high luminous efficacy.

There are many lamp holder assemblies currently available which are adapted to fit incandescent sockets and to provide both mechanical support and electrical input power for various devices including fluorescent lamp systems. Many of these assemblies, however, require alignment of the housing with respect to the incandescent fixture or portable lamp to properly clear the harp used to support a lamp shade. Exemplary of such assembles are the devices shown in U.S. Pat. No. 4,347,460 which issued to Latassa et al on Aug. 31, 1982 and U.S. Pat. No. 4,406,969 which issued to Haraden et al on Sept. 27, 1983. The former mentioned patent shows a fluorescent lamp assembly having a rectangular-shaped housing which may require alignment depending on its dimensions. The latter patent shows a lamp holder assembly having a central body with a pair of projecting arms which may interfere with replacement of the harp. To rectify this condition it is necessary to partially unscrew the assembly, which can result in a loose mechanical fit in the socket and a poor electrical connection.

U.S. Pat. No. 4,405,877, which issued to Haraden et al on Sept. 20, 1983, shows a variably positional lamp holder assembly comprised of a housing having a lower portion carrying a base fixed to the housing in a manner to allow a limited amount of rotational movement of the base relative to the lower portion. The rotational movement of the base is accomplished by providing a circumferentially extending slot formed in the lower portion and a pin fixed on the base which projects into the slot. The width of the slot, which is a determining factor in the amount of rotational movement, is limited in order to retain structural integrity of the lower portion of the housing.

Other lamp holder assemblies available on the market are provided with a base which slips in one direction, i.e., that of tightening. At some point in tightening, the torque exerted overcomes the friction of the base shell threads allowing the housing to continue to rotate while the base is firmly seated in the socket. These assemblies which allow the base to slip are sometimes not dependable because of the variation in the amount friction among different units. Too little friction results in slippage occurring too soon and thus preventing proper connection to the center electrical contact. Too much friction allows overtightening of the lamp holder assembly and may cause distortion to the female threads of the incandescent socket.

BRIEF SUMMARY OF THE INVENTION

It is, therefore, an object of the invention to obviate the disadvantages of the prior art.

It is another object of the invention to enhance the fitting of fluorescent lamps to the sockets of incandescent lamp fixtures.

These objects are accomplished, in one aspect of the invention, by the provision of a lamp holder assembly comprising a first housing having a central body portion and a protruding portion located at one end of the first housing, a base secured to the protruding portion of the first housing and means for permitting a predetermined amount of rotational movement of the base relative to the protruding portion of the first housing. The means for permitting rotational movement includes a rib secured to or forming part of the base and projecting therefrom and stop means secured to or forming part of the first housing and disposed relative to the base for engaging the rib at two spaced apart positions of movement of the rib. The spaced apart positions define the amount of rotational movement.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
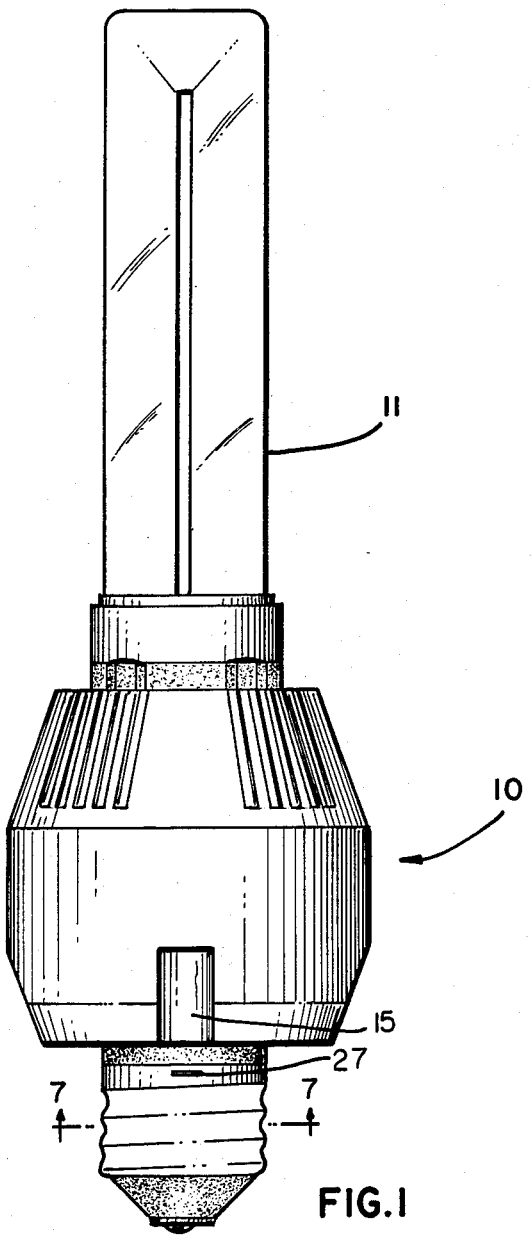
FIG. 1 is a front elevational view of the invention with a lamp.
Figure 2:
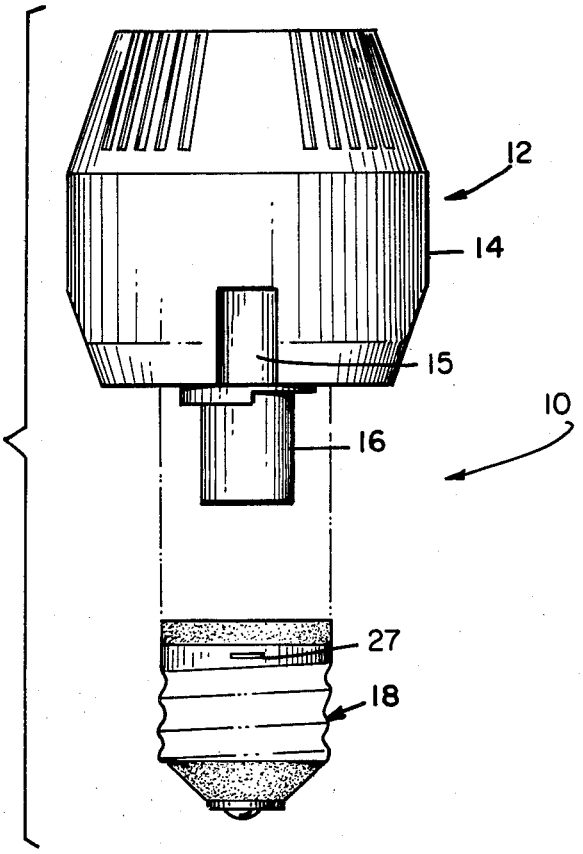
FIG. 2 is an exploded view of the invention showing the first housing and base.

Referring now to the drawings with greater particularity, there is shown in FIG. 1 a lamp holder assembly 10 for the socket of an incandescent lamp fixture. Lamp 11 can be of the fluorescent variety and can have the shape as shown in FIG. 1. As shown in FIG. 2 lamp holder assembly 10 comprises a first housing 12 having a central body portion 14 and a protruding portion 16 located at one end of first housing 12. The central body portion 14 can have local clearances (e.g., slots, grooves 15, or flats 17 as in FIG. 6) formed in the housing for accommodating structural elements of the fixtures, such as the harp of a table lamp, thereby requiring alignment of the housing in relation to the harp. A base 18 is secured to protruding portion 16 of first housing 12.

Figure 3:
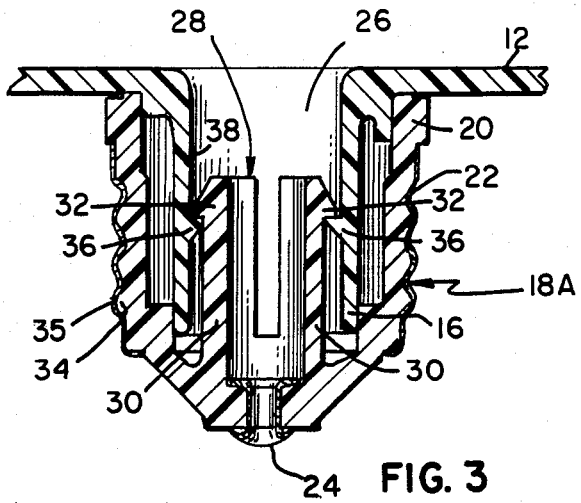
FIG. 3 is a cross-sectional view of one embodiment of the base of the invention.

In the embodiment in FIG. 3, the base 18A includes an insulative second housing 20 having an electrically conductive shell 22 attached thereto and a center electrical contact 24 coaxially disposed at one end of insulative second housing 20. Protruding portion 16 of first housing 12 defines a cavity 26. Base 18A includes a resilient protruding member 28 projecting longitudinally within cavity 26. The internal surface 38 of protruding portion 16 of first housing 12 is provided with an inwardly extending circumferential rim 36. Resilient protruding member 28 of base 18A includes a plurality of prongs 30, each of prongs 30 is provided with an outwardly extending ridge 32 located at one end thereof. Base 18A and protruding portion 16 of first housing 12 are snapped or pushed together so that outwardly extending ridge 32 on prongs 30 engage rim 36 thereby securing base 18A to protruding portion 16.

To strengthen electrically conductive shell 22 for axial loading, insulative second housing 20 on base 18A is provided with an external screw thread 34, and electrically conductive shell 22 has an internal screw thread 35 which mates with external screw thread 34. Electrically conductive shell 22 and insulative second housing 20 can be fixed together by means of a staple 27 (FIGS. 1 and 2).

Figure 4:
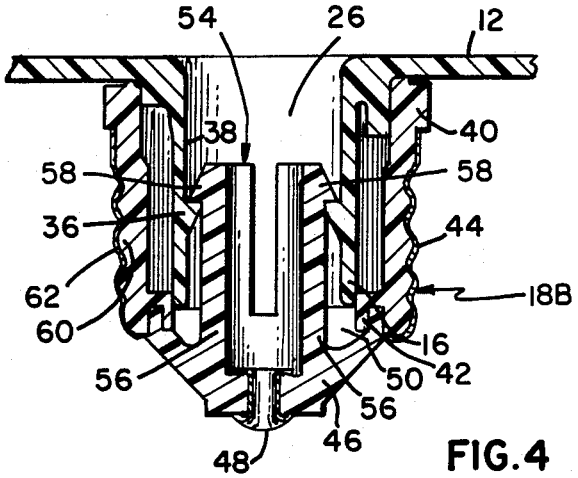
FIG. 4 is a cross-sectional view of another embodiment of the base of the invention.
Figure 5:
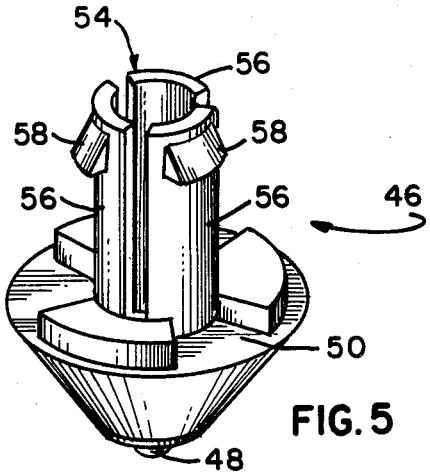
FIG. 5 is a perspective view of the retainer member of the base of FIG. 4.

In another embodiment, as best shown in FIGS. 4 and 5, base 18B includes an insulative second housing 40 having at least one tab 42 projecting longitudinally therefrom. Insulative second housing 40 also has an electrically conductive shell 44 attached thereto. A retainer member 46 included with base 18B has a center electrical contact 48 coaxially disposed thereon and at least one slot 50 formed therein for receiving tab 42 from insulative second housing 40 and allowing mechanical coupling of retainer member 46 to insulative second housing 40.

In accordance with the invention, retainer member 46 includes a resilient protruding member 54 projecting longitudinally within cavity 26 of protruding portion 16 of first housing 12. The internal surface 38 of protruding portion 16 of first housing 12 is provided with an inwardly extending circumferential rim 36. Resilient protruding member 54 of retainer member 46 of base 18B includes a plurality of prongs 56, each of prongs 56 is provided with an outwardly extending ridge 58 located at one end thereof. Base 18B and protruding portion 16 of first housing 12 are snapped or pushed together so that outwardly extending ridge 58 on prongs 56 engage rim 36, thereby securing base 18B to protruding portion 16.

Insulative second housing 40 on base 18B is provided with an external screw thread 60 and electrically conductive shell 44 has an internal thread 62 which mates with external screw thread 60. Electrically conductive shell 44 and insulative second housing 40 can be stapled together.

The first housing 12 of the lamp holder assembly 10 can be hollow and contain therewithin a ballast (not shown) for the lamp which can comprise a transformer, glow starter switch and associated capacitor. Alternatively, the glow starter switch and capacitor can be included within the base of the lamp. The necessary electrical wires can be soldered directly to the electrically conductive shell 22, 44 and center electrical contact 24, 48 of the lamp holder assembly base.

Figure 6:
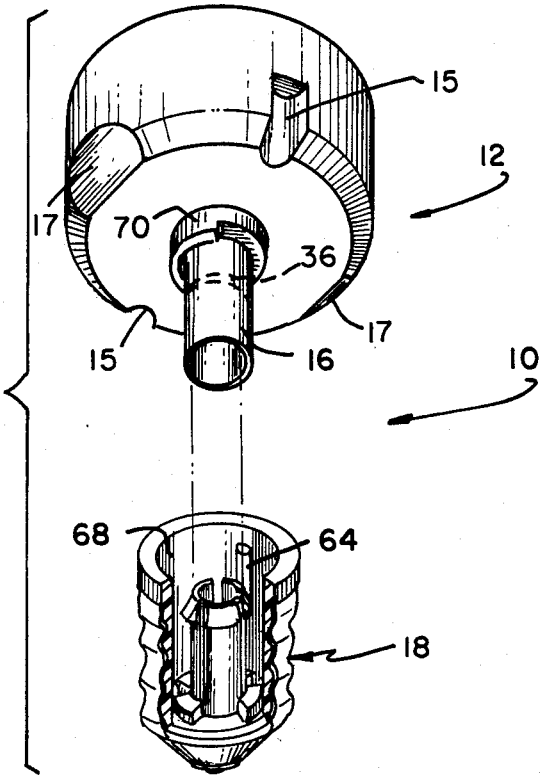
FIG. 6 is an exploded, partially sectional perspective view of one embodiment of the invention.

As best shown in FIG. 6, lamp holder assembly 10 is provided with a means for permitting a predetermined amount of rotational movement of base 18 relative to protruding portion 16 of first housing 12. Rotational movement means includes a rib 64 secured to or forming part of base 18 and projecting therefrom and stop means secured to or forming part of first housing 12 and disposed relative to base 18 for engaging rib 64.

Figure 7:
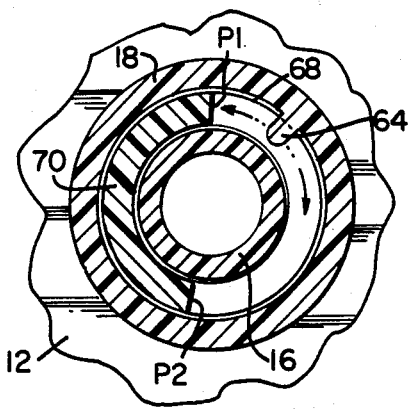
FIG. 7 is a view of a preferred embodiment taken along the line 7—7 of FIG. 1.
Figure 8:
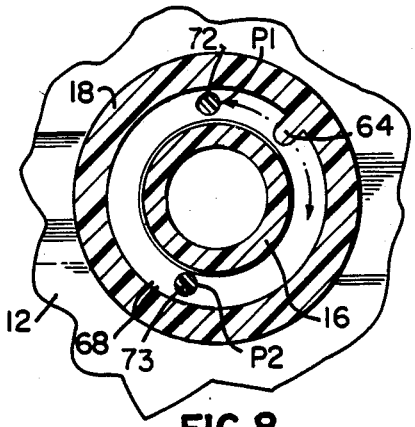
FIGS. 8–10 are views taken along the line 7—7 of FIG. 1 showing further embodiments of the invention.

In a preferred embodiment, rib 64 is located on the internal surface 68 of base 18 (FIGS. 6 and 7). Stop means includes at least a first projecting member 70 located on first housing 12 adjacent internal surface 68 of base 18. In an alternative embodiment shown in FIG. 8, stop means includes two projecting members 72 and 73 spacedly located on first housing 12 adjacent internal surface 68 of base 18.

Figure 9:
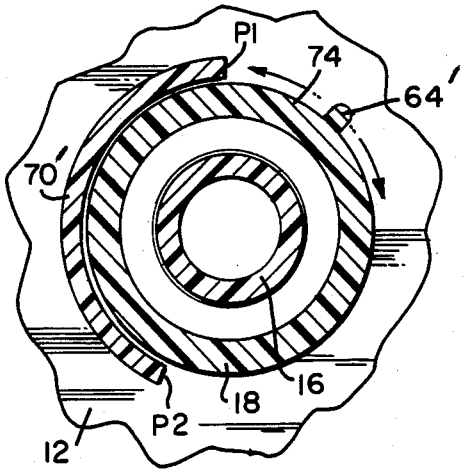
Figure 10:
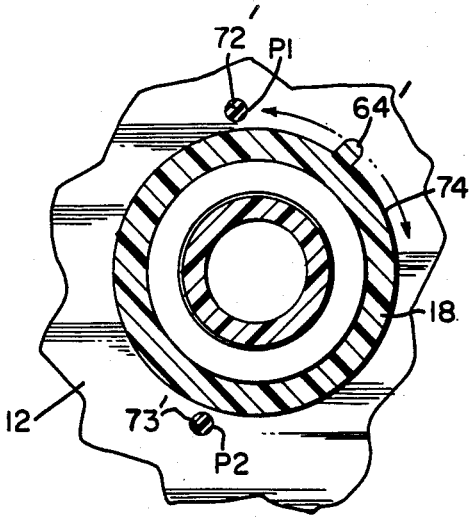

FIGS. 9 and 10 show further embodiments in which rib 64' is located on the external surface 74 of base 18. In FIG. 9 stop means includes at least a first projecting member 70' located on first housing 12 adjacent external surface 74 of base 18.

Alternatively, as shown in FIG. 10, stop means includes two projecting members 72' and 73' spacedly located on first housing 12 adjacent external surface 74 of base 18.

First projecting member 70 or 70' can be arcuate in shape as shown in FIGS. 7 and 9.

Stop means engages rib 64 or 64' at two spaced apart positions (P1 and P2) of movement of rib 64 or 64'. The distance between spaced apart positions P1 and P2 travelled by rib 64 or 64' define the amount of rotational movement, which preferably is about 180°. The amount of rotational movement can be adjusted to another desired amount by increasing or decreasing rib 64 or 64' travelling distance between P1 and P2.

While there have been shown and described what are at present considered to be the preferred embodiments of the invention, it will be apparent to those skilled in the art that various changes and modifications can be made herein without departing from the scope of the invention as defined by the appended claims.

I claim:

1. A lamp holder assembly comprising:

a first housing having a central body portion and a protruding portion located at one end of said first housing, said protruding portion of said first housing defining a cavity and being provided with an inwardly extending circumferential rim:

a base secured to said protruding portion of said first housing and including an insulative second housing having an electrically conductive shell attached thereto, a center electrical contact coaxially disposed at one end of said base, and a resilient protruding member projecting longitudinally within said cavity, said resilient protruding member having an outwardly extending ridge located at one end thereof for engaging said inwardly extending circumferential rim to secure said base to said protruding portion of said first housing; and means for permitting a predetermined amount of rotational movement of said base relative to said protruding portion of said first housing including a rib secured to or forming part of said base and projecting therefrom, and stop means secured to or forming part of said first housing and disposed relative to said base for engaging said rib at two spaced apart positions of movement of said rib, said spaced apart positions defining said amount of said rotational movement.

2. The lamp holder assembly of claim 1 wherein said resilient protruding member of said base includes a plurality of prongs, each of said prongs is provided with an outwardly extending ridge located at one end thereof for engaging said rim.

3. The lamp holder assembly of claim 1 wherein said insulative second housing of said base is provided with an external screw thread, and said electrically conductive shell has an internal thread which mates therewith.

4. The lamp holder assembly of claim 1 wherein said base includes at least one tab projecting longitudinally from said insulative second housing and a retainer member having said center electrical contact coaxially disposed thereon and at least one slot formed therein for receiving said tab.

5. The lamp holder assembly of claim 4 wherein said resilient protruding member forms part of said retainer member and projects longitudinally within said cavity.

6. The lamp holder assembly of claim 5 wherein said resilient protruding member of said retainer member includes a plurality of prongs, each of said prongs being provided with an outwardly extending ridge located at one end thereof for engaging said rim.

7. The lamp holder assembly of claim 4 wherein said insulative second housing is provided with an external screw thread, and said electrically conductive shell has an internal thread which mates therewith.

8. The lamp holder assembly of claim 1 wherein said rib is located on the internal surface of said base.

9. The lamp holder assembly of claim 8 wherein said stop means includes at least a first projecting member located on said first housing adjacent said internal surface of said base.

10. The lamp holder assembly of claim 9 wherein said first projecting member is arcuate in shape.

11. The lamp holder assembly of claim 8 wherein said stop means includes two projecting member spacedly located on said first housing adjacent said internal surface of said base.

12. The lamp holder assembly of claim 1 wherein said rib is located on the external surface of said base.

13. The lamp holder assembly of claim 12 wherein said stop means includes at least a first projecting member located on said first housing adjacent said external surface of said base.

14. The lamp holder assembly of claim 13 wherein said first projecting member is arcuate in shape.

15. The lamp holder assembly of claim 12 wherein said stop means includes two projecting members spacedly located on said first housing adjacent said external surface of said base.

16. The lamp holder assembly of claim 1 wherein said amount of said rotational movement is about 180°.

* * * * *